US007533675B2

(12) United States Patent
Takemura

(10) Patent No.: US 7,533,675 B2
(45) Date of Patent: May 19, 2009

(54) HAIR FIBER MOUNTING METHOD

(75) Inventor: Hitoshi Takemura, Osaka (JP)

(73) Assignee: Dada Co., Ltd, Osaka (JP)

( * ) Notice: Subject to any disclaimer, the term of this patent is extended or adjusted under 35 U.S.C. 154(b) by 292 days.

(21) Appl. No.: 10/507,743

(22) PCT Filed: Oct. 16, 2003

(86) PCT No.: PCT/JP03/13270

§ 371 (c)(1),
(2), (4) Date: Mar. 24, 2005

(87) PCT Pub. No.: WO2004/049847

PCT Pub. Date: Jun. 17, 2004

(65) Prior Publication Data

US 2005/0161057 A1 Jul. 28, 2005

(30) Foreign Application Priority Data

Nov. 29, 2002 (JP) ..... 2002-349225

(51) Int. Cl.
*A41G 3/00* (2006.01)

(52) U.S. Cl. ..... 132/201

(58) Field of Classification Search ..... 132/201
See application file for complete search history.

(56) References Cited

U.S. PATENT DOCUMENTS 3,295,534 A * 1/1967 Dorkin ..... 132/201
4,982,748 A * 1/1991 Trimarchi ..... 132/201
5,121,761 A * 6/1992 Meister ..... 132/201
5,740,819 A * 4/1998 Hicks ..... 132/201
5,758,670 A * 6/1998 Ogunro ..... 132/210
5,881,737 A * 3/1999 Nelson ..... 132/201
2005/0098191 A1 * 5/2005 Frazier ..... 132/201
2006/0086368 A1 * 4/2006 Salinas ..... 132/201

FOREIGN PATENT DOCUMENTS

JP 02041404 2/1990
JP 527016 4/1993

* cited by examiner

*Primary Examiner*—Robyn Doan
*Assistant Examiner*—Rachel R Steitz
(74) *Attorney, Agent, or Firm*—Lowe Hauptman Ham & Berner, LLP

(57) ABSTRACT

A hair-fiber-mounting method that braids natural-hair bundles formed by a person's natural hair and bundling the natural hair with fiber bundles having plural fibers, and makes a loose part of the natural-hair bundles and two end-pans of the fiber bundles hang down from the braiding area, comprising: a) crossing and braiding the natural-hair bundles and the fiber bundles together to form a bundle-joining part, b) repeating the crossing and braiding step so as to make plural bundle-joining parts positioned side by side along a horizontal line of the person's head, and c) repeating further the crossing and braiding step so as to make plural bundle-joining parts from a lower horizontal line of the head to an upper horizontal line, and to make each bundle-joining part positioned above and between two adjacent bundle-joining pans of the immediate lower line so as to be overlapped with each other.

4 Claims, 5 Drawing Sheets

HAIR FIBER MOUNTING METHOD

CROSS-REFERENCE TO RELATED APPLICATIONS

The present Application is based on International Application No. PCT/JP2003/013270, filed on Oct. 16, 2003, entitled "Hair Fiber Mounting Method", which in turn corresponds to Japanese Application JP 2002-349225 filed on Nov. 29, 2002, and priority is hereby claimed under 35 USC §119 based on these applications. Each of these applications are hereby incorporated by reference in their entirety into this application.

DETAILED DESCRIPTION OF THE INVENTION

1. Field of the Invention

This invention relates to a hair-fiber mounting method, in particular to a method of forming a desired hairstyle by attaching hair fibers to a person's natural hair.

2. Description of the Related Art

A desired hairstyle can be realized by making a person's hair look longer by attaching hair fibers to the person's natural hair. This technique is called "hair extension," and it has been disclosed in Japanese Patent No. 3338433.

Briefly, a hair-extension technique includes the following steps: (1) a hair-extension bundle (fiber bundles) and a bundle of natural hair (natural-hair bundle) are crossed with each other, (2) the loose part of the natural-hair bundle is wound around the both parts of the fiber bundle that has been bent into two halves at its middle, (3) the fiber bundle is moved towards the person's scalp by pulling the natural-hair bundle, (4) both halves of the fiber bundles are braided with the loose part of the natural-hair bundle so as to form a braided part, and (5) the braided part is fixed by being partially thermal-fused or bound with elastic threads.

As the material for the hair bundle, burn-resistant polyethylene-based synthetic fibers or the like are selected because of the soft tactile sensation that they provide. However, this extension technique has not been applied to a person's entire head, and therefore a method for applying the hair-extension to all of a person's head is still desired.

Japanese Published Utility Model Application No. 5-27016 has disclosed another hair-extension method. With this method, plural ring-shaped fringe members are provided and connected with each other by plural connection members that extend longitudinally an appropriate distance. The fringe members are formed so as to include elastic members at least at their middle part lengthwise—and some artificial hairs are interwoven with the fringe members. The fringe members are affixed to the natural head hair by connection members, and the person's natural hair is pulled out from the fringe members. However, due to the use of the ring-shaped fringe members, this method has the disadvantage that the hair extension looks unnatural.

The current invention aims at developing a method of attaching fibers (namely, hair extension) to either all or a part—depending on the hairstyle—of person's natural head-hair in a short time, while maintaining a natural-looking hair style.

DISCLOSURE OF THE INVENTION

To achieve the above-mentioned goal, this invention involves a hair-fiber mounting method wherein fiber bundles consisting of plural fibers are braided with natural-hair bundles that are formed by selecting and bundling plural natural head-hairs, and wherein the loose part of the natural-hair bundle (i.e., the part that is not attached to the scalp) and two halves of the fiber bundles are hung together from the braided portions. This method includes:

1. a first stage, wherein a natural-hair bundle and a fiber bundle are crossed, braided, and fixed with each other;
2. a second stage, wherein the first step is repeated along a specified horizontal line of the head at a specified distance from the adjacent bundles;
3. a third stage, wherein bundles-joining areas are formed step by step from the lower part of the person's head to the upper part in such a way that each bundles-joining area is above and between the two adjacent bundles-joining areas of the immediately lower line.

Each of the natural-hair bundles is formed by binding a greater volume of the hair on the upper side of the person's head than on the lower side of the person's head, and in such a way that each selected portion of the natural hair forms an upside-down triangle.

By the method of the present invention, fibers can be attached to the natural hairs in a short time so that the resulting hair extension looks natural.

BRIEF DESCRIPTION OF THE DRAWINGS

FIG. 4(*b*) shows that the natural hairs between the scalp and the bundles-joining area are longer on the upper portion of each natural-hair bundle than on the lower portion of the bundle.

EXPLANATION OF REFERENCE NUMBERS IN THE FIGURES

Figure 1:
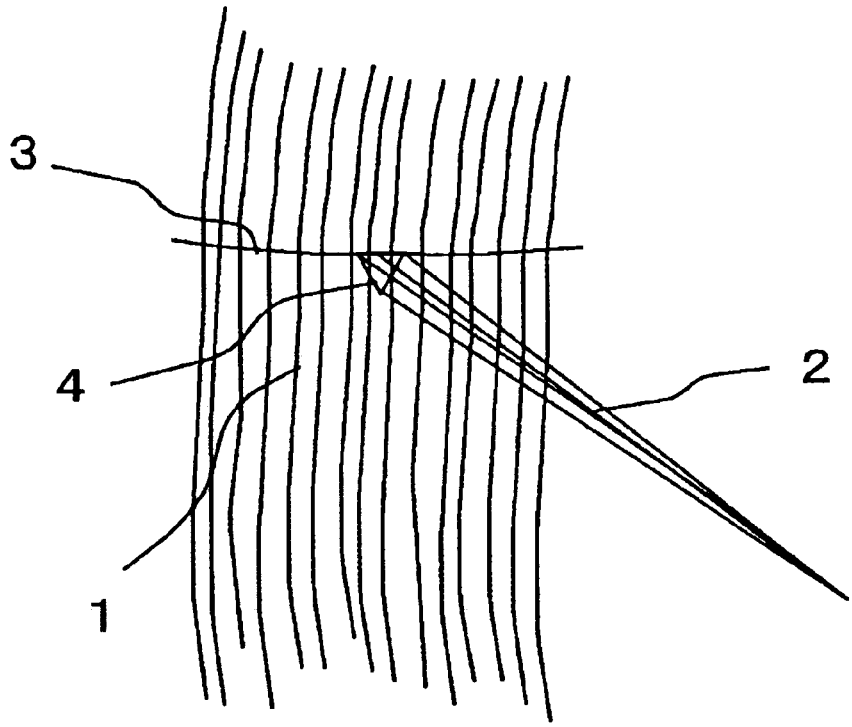
FIG. 1 shows a natural-hair bundle formed by selecting and bundling a plurality of natural hairs.

1 Natural hair
2 Natural-hair bundle
3 Hair-dividing line
4 Hair-selection area
5 Loop
6 Braided portion
7 Fiber bundle
8 Bundles-joining area
10 Scalp
11 Elastic thread

BEST MODES FOR CARRYING OUT THE INVENTION

Embodiments of this invention will now be described while referring to the aforementioned drawings.

FIG. 1 shows a natural-hair bundle 2, which is formed by selecting and bundling a plurality of natural hairs 1 on a person's head. As shown in FIG. 1, the natural hairs 1 are selected along a hair-dividing line 3 in such a way that hairs are thinner toward the lower end of the natural-hair bundle 2 than at the upper end of said bundle 2, so that the selected hair forms an upside-down triangle.

Figure 2:
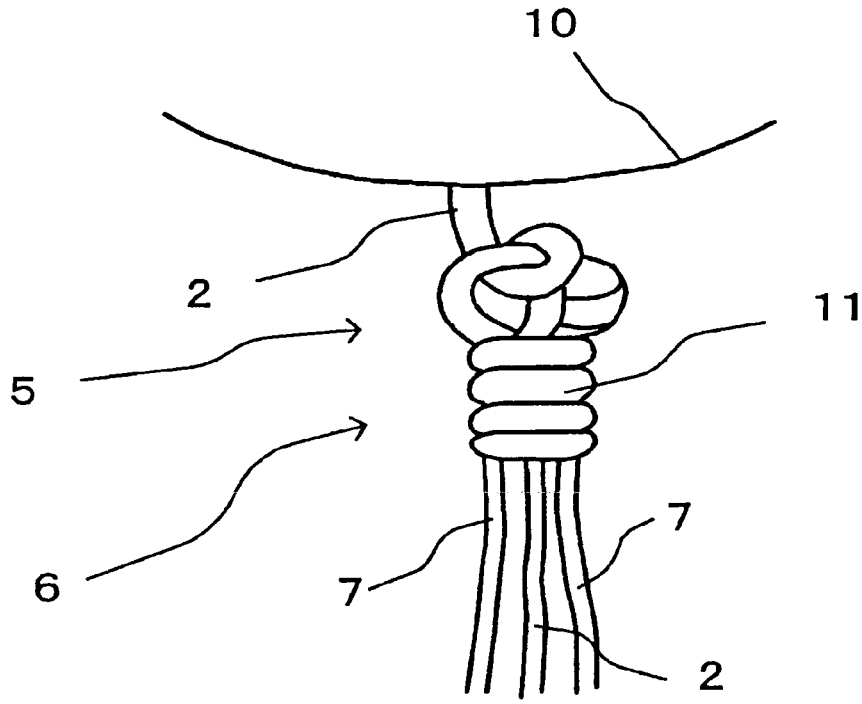
FIG. 2 shows a joined-hair bundle in which a natural-hair bundle and a fiber bundle have been joined each other, with the loose part of the natural-hair bundle and the two halves of the fiber bundle hanging from the joined portion.

FIG. 2 shows a joined-hair bundle which is formed by tying a natural-hair bundle 2 and a fiber bundle 7 with each other so that the loose part of the natural-hair bundle 2 and the two halves (end-parts) of the fiber bundle 7 hang from their joined portion.

The method of forming the joined-hair bundle includes: a natural-hair bundle 2 and a fiber bundle 7 with predetermined length are crossed with each other roughly in the center of the fiber bundle 7 (the crossing of the natural-hair bundle 2 and the fiber bundle 7 may be made either near to the right end or to the left end of the fiber bundle 7); and in this case, the natural-hair bundle hangs down, crossing the horizontally placed fiber bundle 7, and then, the loose part of the natural-hair bundle 2 is wound on the left and on the right of the crossing portion at least once respectively. This process is referred to as a winding process. This winding process is to form a loop 5 at the crossing portion by winding the natural-hair bundle 2 once around on the right (left) of the fiber bundle 7, and then by winding the natural-hair bundle 2 once around on the left (right) of the fiber bundle 7 successively. At this stage, the loose part of the natural-hair bundle 2 hangs down, and furthermore, two halves (end-parts) of the fiber bundle 7 with pre-determined length hang down from the point of the loop 5. Then, the loose part of the natural-hair bundle 2 and the two halves (end-parts) of the fiber bundle 7 are braided near at the crossing portion, being linked to the loop 5, so as to bind the natural-hair bundle 2 with the fiber bundle 7.

The braided portion 6 is fixed by winding a separated portion of the fiber bundle 7 around the braided portion 6.

In the meantime, the braided portion 6 is formed by braiding three end-parts, i.e., the two halves (end-parts) of the fiber bundle 7 with a loose part of the natural-hair bundle 2. Also, the braided portion 6 may be fixed by winding and binding an elastic thread 11 around the joined hair bundle several times (5 to 7 times).

As can be seen in FIG. 2, a loop 5 and the braided portion 6 (around which elastic thread 11 is wound) are formed so as to make the loose part of the natural-hair bundle 2 and the two halves (end-parts) of the fiber bundle 7 hang below the braided portion 6.

Also, as appropriate, a part of the fiber bundle 7 can also be thermally fused to fix the braided portion 6. But it is better to use elastic thread 11 in order to avoid the risk of burning caused by the thermal-fusion. Another benefit of using elastic thread 11 is that an fiber bundle 7 that has been attached can be easily removed simply by cutting the elastic thread 11.

Figure 3:
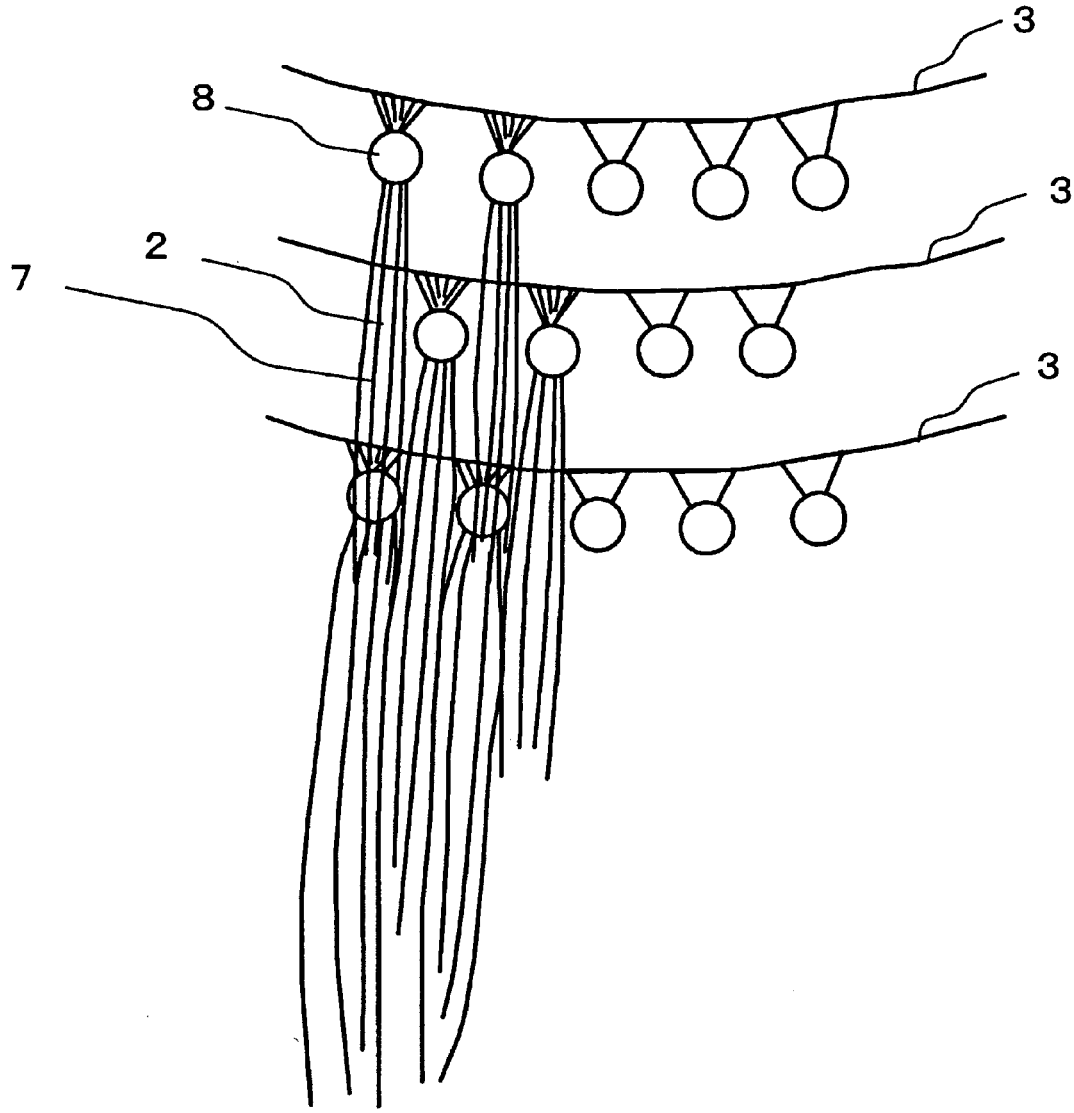
FIG. 3 shows several extensions that have been formed from the lower area to the upper area of a person's head in such a way that each joined-hair bundle is placed at above and between the two adjacent lower joined-hair bundles; in other words, so that each joined-hair bundle along a horizontal line do not overlap the joined-hair bundle immediately below it.

FIG. 3 shows a bundles-joining area 8, which, as is shown in FIG. 2, is composed of a loop 5 and a braided portion 6 (around which elastic thread 11 is wound), and extended natural-hair bundles 2 and fiber bundles 7 that hang below the bundles-joining area 8. As is clear from FIG. 3, the extension (attachment of fibers) is performed in such a way that the joined-hair bundle areas 8 are formed along dividing lines 3 of the head. First, joined-hair bundle areas 8 are formed along the lowest hair-dividing line 3, then other joined-hair bundle areas 8 are formed along the mid-level hair-dividing line 3, and then along the upper hair-dividing line 3 in succession. At this time, it is desirable that none of the hairs hanging down from a bundles-joining area 8 overlaps the hairs hanging down from the immediately lower bundles-joining area 8. To achieve this, each joined-hair bundle area 8 formed along the upper hair-dividing line 3 is placed above and between two adjacent bundle joining areas 8 formed along the immediately lower hair-dividing line 3.

Figure 4:
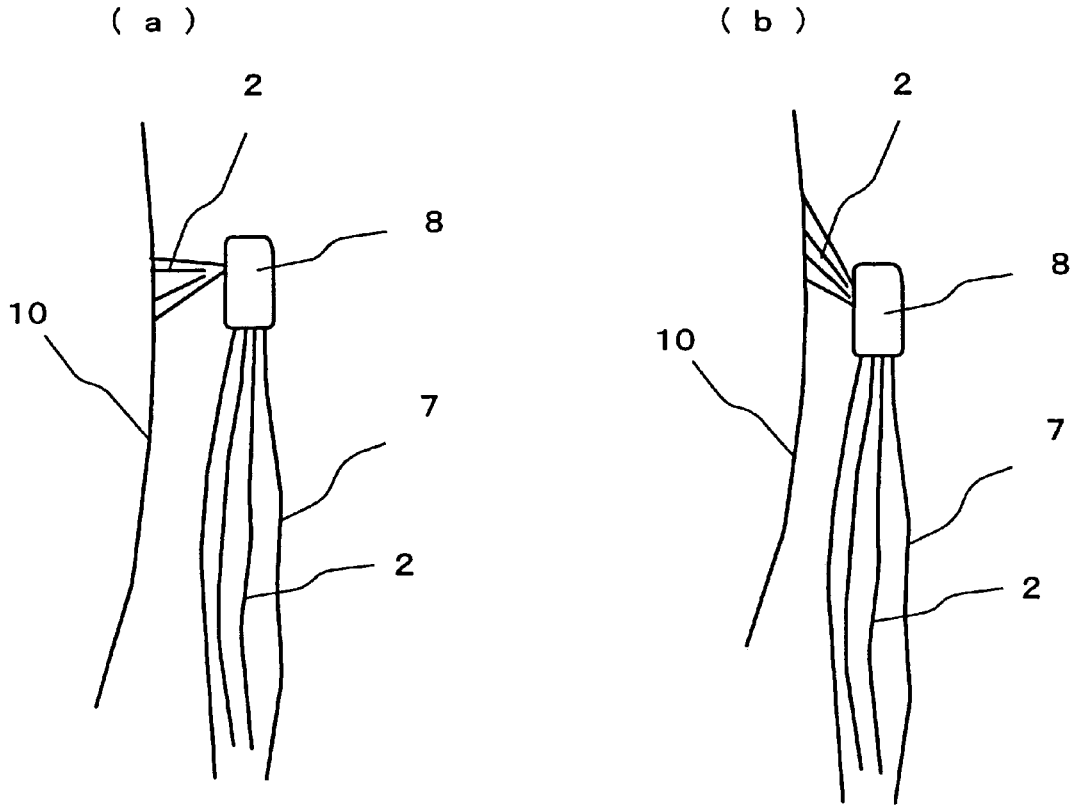
FIGS. 4(*a*) and 4(*b*) show the lengths of natural hairs between the scalp and the bundles-joining area.

FIG. 4(*b*) shows that a fiber bundle 7 is attached in such a manner that the length of natural-hair between the scalp 10 and the bundles-joining area 8 is longer in the upper portion of the natural-hair than in the lower portion thereof. This difference in hair length helps to minimize the burden on the scalp 10. If all the hairs of each bundle were the same length as shown in FIG. 4(*a*), the burden on the scalp in the lower portion would be greater than that of upper portion.

Figure 5:
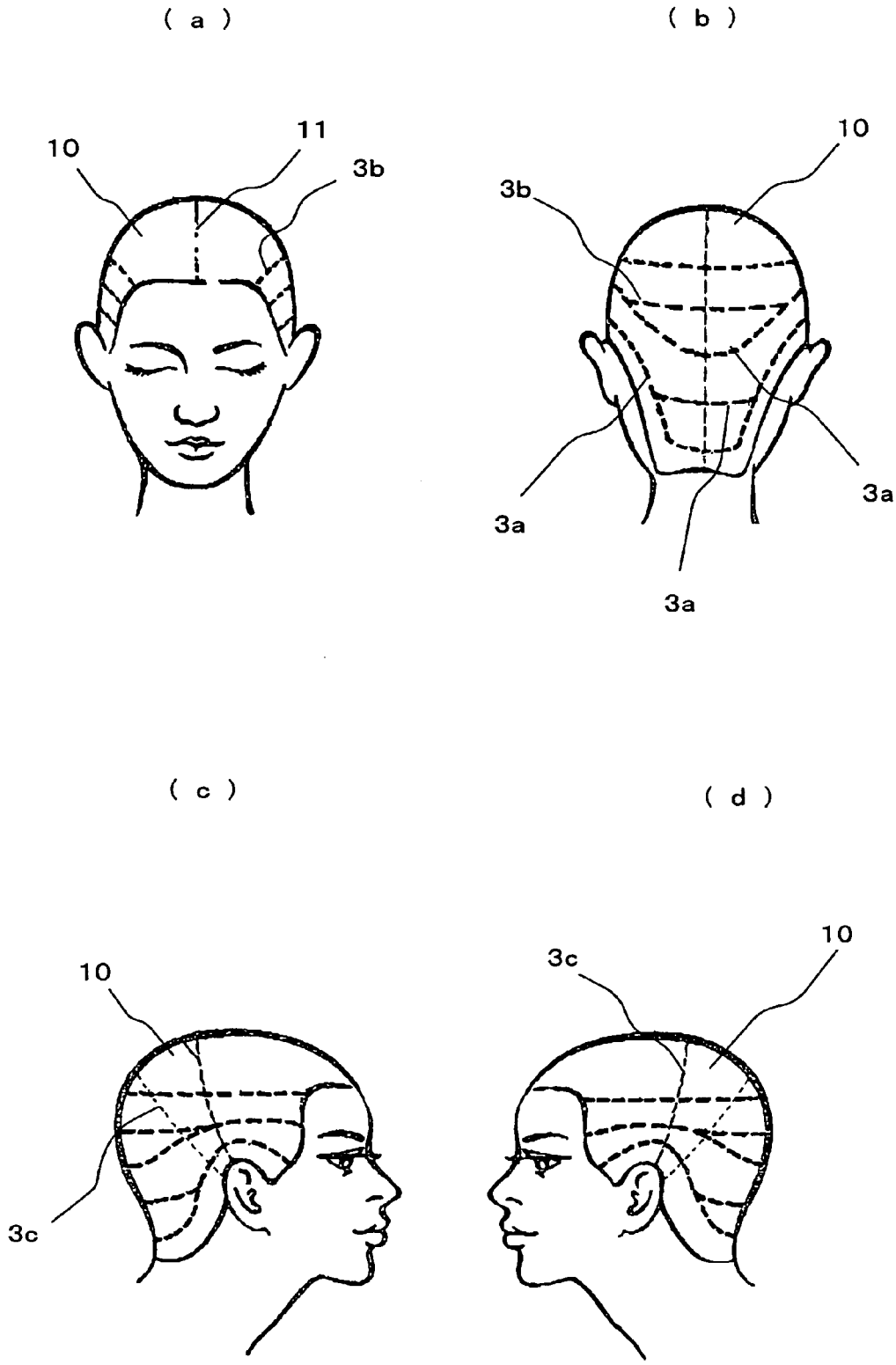
FIGS. 5(*a*), (*b*), (*c*), and (*d*) show, respectively, front, back, right-side, and left-side views of hair-extension layouts on a head.

The extensions are formed so as to cover the entire head. Some hairs of the extended portion can be cut, depending on the hairstyle,. FIGS. 5(*a*), 5(*b*), 5(*c*), and 5(*d*) show, respectively, front, back, right-side, and left-side views of hair-extension layouts on a head in which hairs have been cut. As FIG. 5 shows, it is the lower part of the head hair, shown by lines 3*a*, that determines the end lines of a hairstyle (i.e., the length of the hair). Similarly, the portions that determine the volume (which creates the form and silhouette of a hairstyle) are along the line 3*b*, and the portions that express the natural texture of the extended-hair surface and its fitness with natural hair are along the line 3*c*.

Figure 6:
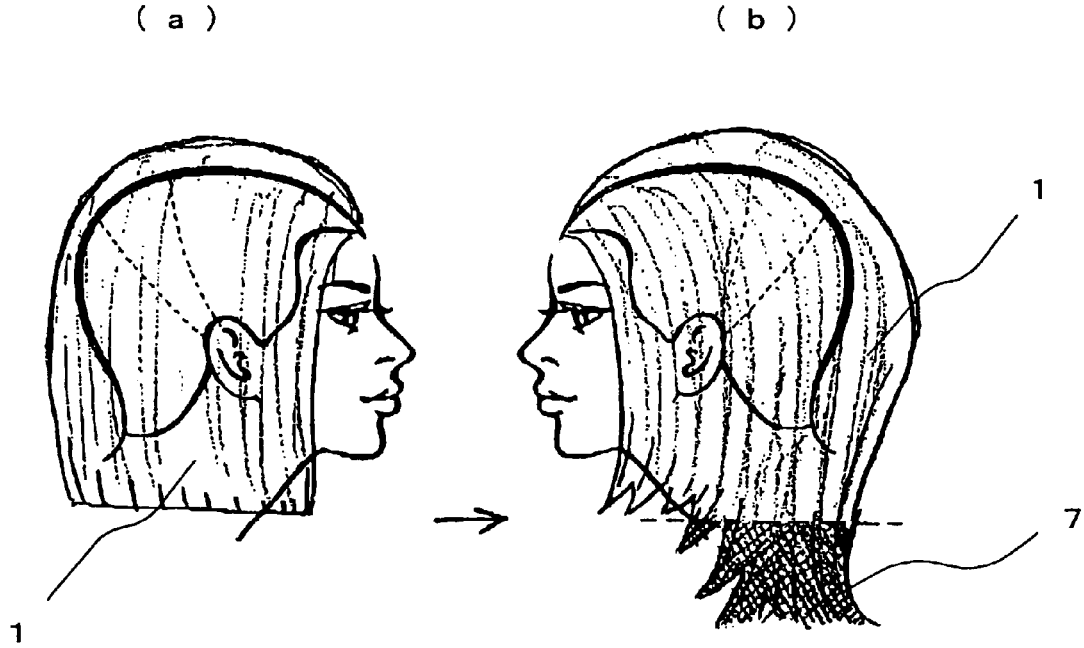
FIGS. 6(*a*) and (*b*) show hairstyles before and after extensions have been attached to the head.
Figure 7:
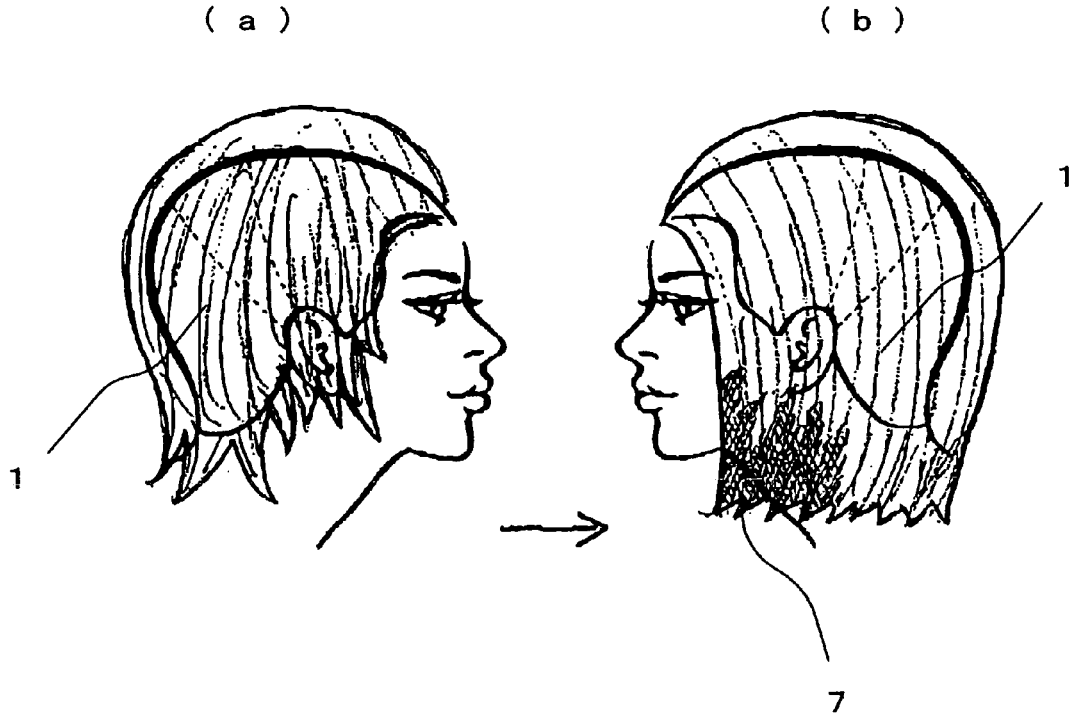
FIGS. 7(*a*) and (*b*) also show hairstyles before and after extensions have been attached.

FIGS. 6 and 7 illustrate the final phase of hairstyles after the extension has been completed.

The hairstyle shown in FIG. 6(*a*) is commonly called a "bob," which is extended by using fiber bundles 7 so that a layered style as shown in FIG. 6(*b*) can be obtained. In other words, this extension is intended to create a "from-bob-to-layered" style, where each extension is attached to hair on the back part of the head and below a line that extends between the two ears (line 3*b* in FIG. 5).

FIG. 7 shows a "from-layered-to-bob" style, which is the opposite of the "bob-to-layered" style. That is to say, in order to change the hairstyle shown in FIG. 7(*a*) to the hairstyle shown in FIG. 7(*b*), fiber bundles 7 are used to extend the hair. The extensions are attached to the front part of a person's head hair and above the aforementioned line that extends between the person's two ears (line 3*b* in FIG. 5). The above-mentioned extensions are attached to parts of the person's head hair. When short hair is changed to longer hair, extensions are attached to all parts of a person's head-hair.

INDUSTRIAL APPLICABILITY

This invention has benefits as described below.

The method of this invention includes

1). a first stage, wherein a natural-hair bundle and a fiber bundle are crossed, braided, and fixed with each other.

2). a second stage, wherein the first steps are repeated along a specified horizontal line of the head at a specified distance from the adjacent bundles;

3). a third stage, wherein bundles-joining areas are formed step by step from the lower part of the person's head to the upper part in such a way that each bundles-joining area is above and between the two adjacent bundles-joining areas of the immediately lower line.

With this invention, hair-extension can be carried out in a short time while maintaining a natural-looking appearance.

A greater volume of hair is selected at the upper side of the head than at the lower side, and the part of each natural-hair bundle that is between the scalp and the bundles-joining area is longer than the part below the bundles-joining area.

With this invention, the burden on the scalp can be minimized.

Further, each joined-hair bundle is placed at an upper part between the two adjacent lower joined-hair bundles, in other words that the joined-hair bundles along a line do not overlap the joined-hair bundles along the immediately below line.

With this invention, the natural appearance of the hair is improved.

What is claimed is:

1. A hair-fiber-mounting method, comprising the steps of:

forming natural-hair bundles by selecting and bundling a plurality of a person's natural head-hairs;

forming each of the natural hair bundles by binding a greater volume of the hair on the upper side of the person's head than on the lower side of the person's head in such a way that each selected portion of the natural hair forms an upside-down triangle;

crossing and braiding a natural hair bundle and a fiber bundle together to form a crossing portion, wherein said natural-hair bundle is wound around said fiber bundle at least once on the right and at least once on the left of said crossing portion to form a loop portion;

braiding a loose part of said natural-hair bundle and two end-parts of said fiber bundle in a three strand braiding movement so that a braided portion is formed; and selecting and winding the fiber bundles around the braided portion so that the braided portion is fixed.

2. The hair-fiber mounting method according to claim 1, wherein the natural-hair between a user's scalp and an area where joining of bundles are made is longer in the upper portion of the natural-hair bundle than in the lower portion thereof.

3. A hair-fiber-mounting method, comprising the steps of:

forming natural-hair bundles by selecting and bundling a plurality of a person's natural head-hairs;

forming each of the natural hair bundles by binding a greater volume of the hair on the upper side of the person's head than on the lower side of the person's head in such a way that each selected portion of the natural hair forms an upside-down triangle;

crossing and braiding a natural hair bundle and a fiber bundle together to form a crossing portion, wherein said natural-hair bundle is wound around said fiber bundle at least once on the right and at least once on the left of said crossing portion to form a loop portion;

braiding a loose part of said natural-hair bundle and two end-parts of said fiber bundle in a three strand braiding movement so that a braided portion is formed; and winding an elastic thread around the braided portion plural times so that the braided portion is fixed.

4. The hair-fiber mounting method according to claim 3, wherein the natural-hair between a user'scalp and an area where joining of bundles are made is longer in the upper portion of the natural-hair bundle than in the lower portion thereof.

* * * * *